US008092350B2

(12) United States Patent
Chinag

(10) Patent No.: US 8,092,350 B2
(45) Date of Patent: Jan. 10, 2012

(54) ELECTRIC STEPPER

(75) Inventor: Yu-Sung Chinag, Guangzhou (CN)

(73) Assignee: Guangzhou Fei da Exercise & Massager Equipment Co., Ltd., Guangzhou (CN)

( * ) Notice: Subject to any disclaimer, the term of this patent is extended or adjusted under 35 U.S.C. 154(b) by 0 days.

(21) Appl. No.: 12/776,994

(22) Filed: May 10, 2010

(65) Prior Publication Data

US 2011/0077131 A1 Mar. 31, 2011

(30) Foreign Application Priority Data

Sep. 29, 2009 (CN) ..... 2009 2 0236591 U

(51) Int. Cl.
*A63B 22/00* (2006.01)
*A61H 1/00* (2006.01)

(52) U.S. Cl. ..... 482/52; 601/35

(58) Field of Classification Search ..... 482/51–53, 482/57, 148, 79–80; 601/27–35
See application file for complete search history.

(56) References Cited

U.S. PATENT DOCUMENTS 2,093,830 A * 9/1937 Flatley ..... 601/29
2,206,902 A * 7/1940 Kost ..... 601/27
4,676,501 A * 6/1987 Hoagland et al. ..... 482/51
5,336,146 A * 8/1994 Piaget et al. ..... 482/54
5,569,127 A * 10/1996 Johnston ..... 482/52
5,626,539 A * 5/1997 Piaget et al. ..... 482/54
5,645,512 A * 7/1997 Yu ..... 482/53
6,572,514 B1 * 6/2003 Calafato ..... 482/79
6,582,344 B2 * 6/2003 Tang ..... 482/53
6,893,383 B1 * 5/2005 Chang et al. ..... 482/54
6,899,657 B2 * 5/2005 Chuang ..... 482/52
7,041,037 B2 * 5/2006 Huang ..... 482/53
7,104,928 B1 * 9/2006 Liu et al. ..... 482/52
7,137,928 B1 * 11/2006 Chen ..... 482/53
7,819,779 B2 * 10/2010 Chang ..... 482/54
2009/0305850 A1 * 12/2009 Shiraishi et al. ..... 482/52
2011/0028276 A1 * 2/2011 Sanematsu et al. ..... 482/52

* cited by examiner

*Primary Examiner* — Stephen Crow
(74) *Attorney, Agent, or Firm* — Chun-Ming Shih

(57) ABSTRACT

An electric stepper includes a base having a rotation shaft, a pivot and a post; an upright rod fixed on the post; a main seat mounted on the base, having a tube sheathing on the rotation shaft and a horizontal shaft; a left support on the left of the horizontal shaft; a right support on the right of the horizontal shaft; a left link, two ends of which are separately connected to the front of the left support and a left crank; a right link, two ends of which are separately connected to the front of the right support and a right crank; a rocker arm pivotally fixed on the pivot of the base and connected to the left crank; a bearing set connecting between the left crank and right crank and having a driven wheel; and a gear box at the rear end of the main seat and having a driving wheel for driving the driven wheel through a belt.

2 Claims, 2 Drawing Sheets

ELECTRIC STEPPER

BACKGROUND OF THE INVENTION

1. Technical Field

The invention relates to exercise devices, particularly to steppers.

2. Related Art

Office workers who lack exercise always expect a convenient and simple exercise. Usually they can not have a room which is large enough to accommodate a large exercise device. Thus compact and efficient steppers appear in the market and become popular.

Steppers may enhance cardiopulmonary function and exercise legs. Stepping exercise is aerobics, which does not tend to tire in comparison with traditional exercises. Steppers can exercise legs and hips to lose weight. The cardiopulmonary function can be enhanced if stepping faster.

Conventional steppers are provided with hydraulic cylinders. Stepping frequency might be limited by the hydraulic cylinders, so that the stepping frequency is hard to be adjusted for various users. Therefore, the conventional steppers must be improved.

SUMMARY OF THE INVENTION

A primary object of the invention is to provide an electric stepper which can achieve great exercise effect.

A secondary object of the invention is to provide an electric stepper which can increase pleasure by adding corresponding music.

To accomplish the above objects, the electric stepper of the invention includes a base to be horizontally placed on the ground, having a rotation shaft, a pivot and a post; an upright rod fixed on the post; a main seat mounted on the base, having a tube sheathing on the rotation shaft and a horizontal shaft; a left support on the left of the horizontal shaft; a right support on the right of the horizontal shaft; a left link, two ends of which are separately connected to the front of the left support and a left crank; a right link, two ends of which are separately connected to the front of the right support and a right crank; a rocker arm pivotally fixed on the pivot of the base and connected to the left crank; a bearing set connecting between the left crank and right crank and having a driven wheel; and a gear box at the rear end of the main seat and having a driving wheel for driving the driven wheel through a belt.

DETAILED DESCRIPTION OF THE INVENTION

Figure 1:
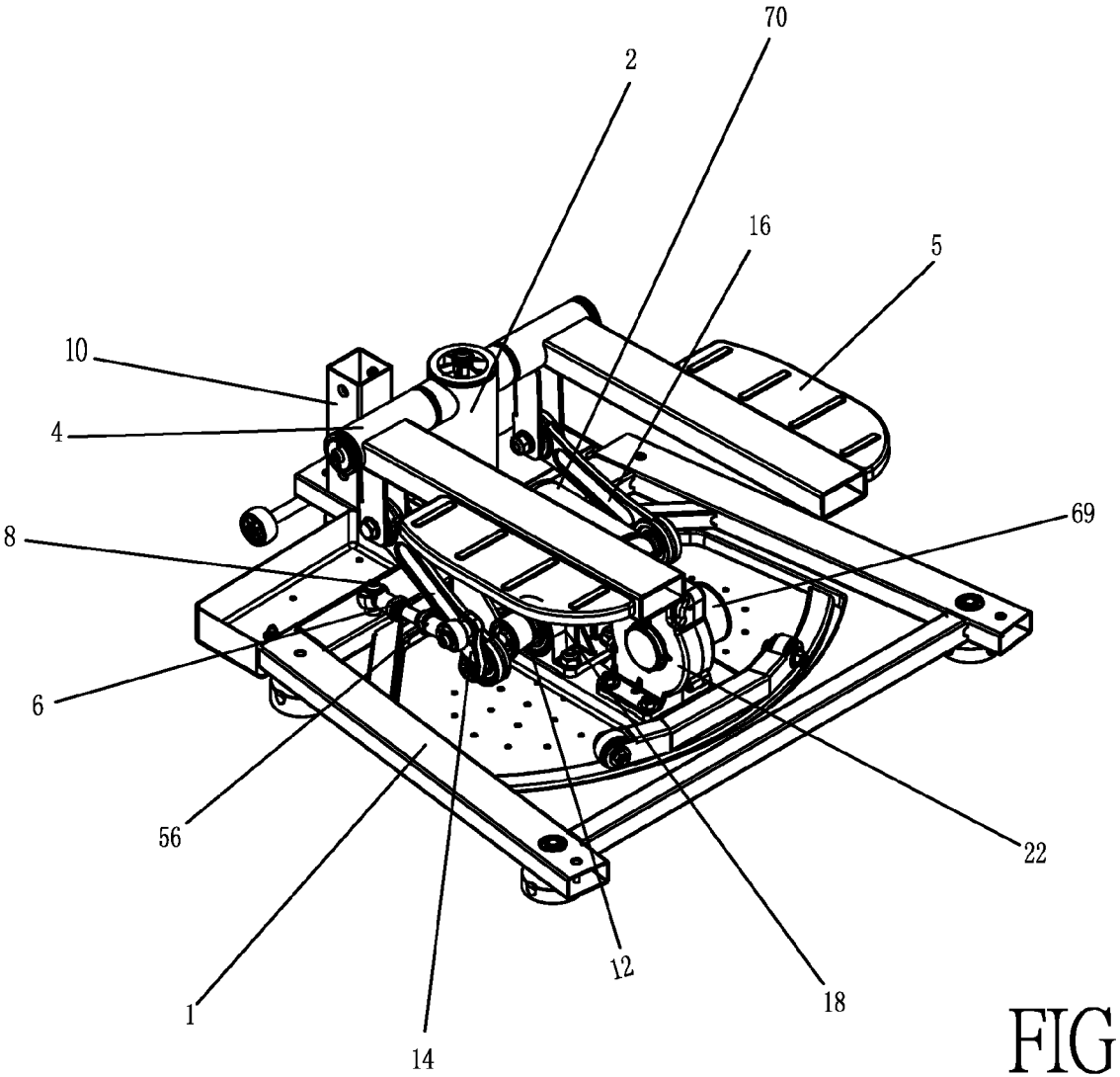
FIG. 1 is a perspective view of the electric stepper of the invention.
Figure 2:
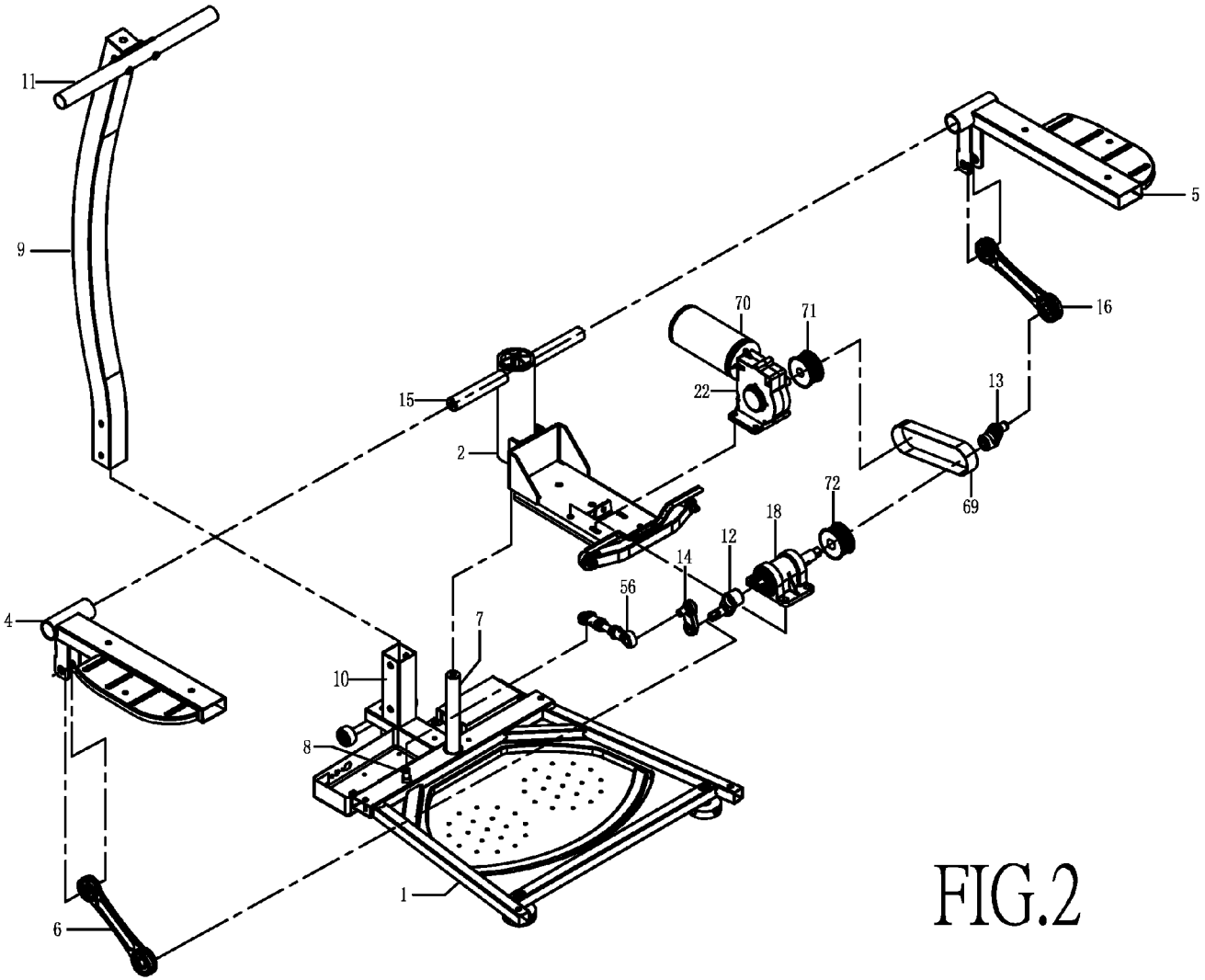
FIG. 2 is an exploded view of the electric stepper of the invention.

Please refer to FIGS. 1 and 2. The electric stepper of the invention includes a base 1 to be horizontally placed on the ground, having a rotation shaft 7, a pivot 8 and a post 10; an upright rod 9 fixed on the post 10; a main seat 2 mounted on the base 1, having a tube 3 sheathing on the rotation shaft 7 and a horizontal shaft 15; a left support 4 on the left of the horizontal shaft 15; a right support 5 on the right of the horizontal shaft 15; a left link 6, two ends of which are separately connected to the front of the left support 4 and a left crank 12; a right link 16, two ends of which are separately connected to the front of the right support 5 and a right crank 13; a rocker arm 14 pivotally fixed on the pivot 8 of the base 1 and connected to the left crank 12; a bearing set 18 connecting between the left crank 12 and right crank 13 and having a driven wheel 72; and a gear box 22 at the rear end of the main seat 2 and having a driving wheel 71 for driving the driven wheel 72 through a belt 69.

As shown in FIGS. 1 and 2, to be convenient for upper limb exercise of users, the upright rod 9 is provided with a handle 11.

The driving wheel 71 of the gear box 22 is driven by a motor 70, and the driven wheel 72 is also driven through the belt 69. Then the left crank 12 drives the left link 6 to make the left support 4 move upwards and downwards with respect to the horizontal shaft 15. Similarly, the right crank 13 drives the right link 16 to make the right support 5 move upwards and downwards with respective the horizontal shaft 15. When the left support 4 moves downwards, the rocker arm 14 connecting the left link 6 and the left crank 12 is forced, and the main seat 2 rotates leftwards about the rotation shaft 7 by means of a multi-section link 56 and the pivot 8. On the other hand, driven by the left crank 12, the right crank 13 and the rotation shaft 7, the right support 5 will move with respect to the left support 4. Therefore, the user standing on the left support 4 and right support 5 can do a stepping exercise by the power assistance of the motor 70.

Furthermore, the frequency of the driving wheel 71 driven by the motor 70 might associate with an external audio player (such as walkmans and MP3 players). The external audio player (not shown) might transmit audio signals to the motor 70 by wire or wirelessly to have the motor 70 operate correspondingly. This will increase pleasure during exercise.

What is claimed is:

1. An electric stepper comprising:

a base to be horizontally placed on the ground, having a rotation shaft, a pivot and a post;

an upright rod fixed on the post;

a main seat mounted on the base, having a tube sheathing on the rotation shaft and a horizontal shaft;

a left foot support pivotally supported on the left of the horizontal shaft;

a right foot support pivotally supported on the right of the horizontal shaft;

a left link, two ends of which are separately connected to the front of the left support and a left crank;

a right link, two ends of which are separately connected to the front of the right support and a right crank;

a rocker arm pivotally fixed on the pivot of the base and connected to the left crank;

a bearing set connecting between the left crank and right crank and having a driven wheel;

a gear box at the rear end of the main seat and having a driving wheel for driving the driven wheel through a belt; and a motor coupled to the driving wheel of the gear box wherein a user standing on said supports can do a stepping exercise while assisted by said motor.

2. The electric stepper of claim 1, further comprising a handle mounted on the upright rod.

* * * * *